US006730656B2

(12) United States Patent
Hartshorn et al.

(10) Patent No.: US 6,730,656 B2
(45) Date of Patent: May 4, 2004

(54) DETERGENT COMPOSITIONS

(75) Inventors: Richard Timothy Hartshorn, Lawrenceburg, IN (US); Alison Lesley Main, Whitley Bay (GB); Nathalie Sophie Letzelter, Newcastle-Upon-Tyne (GB); Barry Thomas Ingram, Whitley Bay (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/386,997

(22) Filed: Mar. 12, 2003

(65) Prior Publication Data

US 2004/0005993 A1 Jan. 8, 2004

Related U.S. Application Data

(63) Continuation of application No. PCT/US01/28476, filed on Sep. 13, 2001.

(30) Foreign Application Priority Data

Sep. 19, 2000 (GB) ..... 0022906

(51) Int. Cl.[7] ..... C11D 3/08

(52) U.S. Cl. ..... 510/507; 510/276; 510/287; 510/334; 510/444; 510/445; 510/470; 510/471; 510/485; 510/515

(58) Field of Search ..... 510/507, 276, 510/287, 334, 444, 445, 470, 471, 485, 515

(56) References Cited

U.S. PATENT DOCUMENTS

| | | | | |
|---|---|---|---|---|
| 3,862,058 | A | | 1/1975 | Nirschl et al. |
| 3,993,573 | A | | 11/1976 | Gloss |
| 4,062,647 | A | * | 12/1977 | Storm et al. ..... 8/137 |
| 4,196,104 | A | * | 4/1980 | Oguagha ..... 510/330 |
| 4,338,204 | A | * | 7/1982 | Spadini et al. ..... 510/301 |
| 4,444,674 | A | | 4/1984 | Gray |
| 5,234,620 | A | | 8/1993 | Brace et al. |
| 5,443,750 | A | * | 8/1995 | Convents et al. ..... 510/322 |
| 6,313,080 | B1 | * | 11/2001 | Boskamp et al. ..... 510/298 |
| 6,436,889 | B1 | * | 8/2002 | Sta et al. ..... 510/298 |

FOREIGN PATENT DOCUMENTS

| | | |
|---|---|---|
| EP | 0 026 529 A1 | 4/1981 |
| EP | 0 297 673 A2 | 1/1989 |

* cited by examiner

*Primary Examiner*—Charles Boyer
(74) *Attorney, Agent, or Firm*—Julia A. Glazer; Brahm J. Corstanje; Kim William Zerby

(57) ABSTRACT

A solid detergent composition comprising a clay system, said clay system comprises a hectorite clay and a dioctahedral smectite clay, wherein the weight ratio of said hectorite clay to said dioctahedral smectite clay is less than 1:1. The two clay types may be present in a solid detergent composition in the form of an agglomerate.

9 Claims, No Drawings

DETERGENT COMPOSITIONS

CROSS REFERENCE TO RELATED APPLICATIONS

This is a continuation of International Application PCT/US01/28476 with an international filing date of Sep. 13, 2001, published in English under PCT Article 21(2) which claims priority to Great Britain Application No. 0022906.2, filed Sep. 19, 2000.

TECHNICAL FIELD

The present invention relates to solid fabric or cleaning compositions, especially laundry detergent compositions that provide fabric softening benefits during the washing process.

BACKGROUND OF THE INVENTION

There is a consumer demand for solid laundry detergents that provide fabric softening benefits during the washing process. To meet this demand, the laundry industry typically adds a softening agent to solid detergent products. These softening agents do not always efficiently deposit onto fabric, they do not disperse well or do not deposit evenly on to the fabric surface, and are removed from the wash liquor during the washing cycle, hence the softening benefit they provide during the washing cycle still needs to be improved. Currently, the laundry industry typically adds flocculating aids to solid detergent compositions comprising clay, to improve clay deposition onto fabric. However, there is still a need to further improve the efficiency of clay deposition onto fabric in such a manner that an improved fabric softening benefit is achieved.

The Inventors have surprisingly found that by using a combination of specific clays, these clays provide an improved fabric softening benefit over several washing cycles, compared to when the same amount of a single clay type is used.

Moreover, it is believed that a combination of specific types of clay, acts in such a manner as to disperse better and more readily deposit onto fabric in such a manner so that the fabric softening benefit over several washing cycles is improved, compared to when only one clay type is used.

Furthermore, the Inventors have found that when the two clay types are present in a solid detergent composition in the form of an agglomerate, then the fabric softening benefit provided by the solid detergent composition during the washing cycle is further improved. The Inventors have also found that when the two clay types are present in the same agglomerate, then the fabric softening benefit provided is further improved, compared to two separate clay agglomerates being used.

The Inventors have also found that adding a hydrophobically modified cellulosic based polymer to a solid detergent composition comprising specific types of clay, further improves the fabric softening benefit provided and also provides a fabric anti-wrinkling benefit, over several washing cycles.

SUMMARY OF THE INVENTION

In a first embodiment of the present invention, a solid detergent composition is provided which comprises hectorite clay and dioctahedral smectite clay, wherein the weight ratio of said hectorite clay to said dioctahedral smectite clay is less than 1:1.

In a second embodiment of the present invention, the use of a solid detergent composition comprising hectorite clay and dioctahedral smectite clay, wherein the weight ratio of said hectorite clay to said dioctahedral smectite clay is less than 1:1, to provide fabric softening benefits to fabric, is provided.

In a third embodiment of the present invention, the use of a solid detergent composition comprising hectorite clay, dioctahedral smectite clay and a hydrophobically modified cellulosic based polymer, wherein the weight ratio of said hectorite clay to said dioctahedral smectite clay is less than 1:1, to provide fabric softening benefits and fabric anti-wrinkling benefits to fabric, is provided.

DETAILED DESCRIPTION OF THE INVENTION

Hectorite Clay

The composition herein comprises hectorite clay. Typical hectorite clay for use herein has the general formula $$[(Mg_{3-x}Li_x)Si_{4-y}Me^{III}_yO_{10}(OH_{2-z}F_z)]^{-(x+y)}((x+y)/n)M^{n+} \quad (I)$$

wherein y=0 to 0.4, if y=>0 then $Me^{III}$ is Al, Fe or B, preferably y=0; $M^{n+}$ is a monovalent (n=1) or a divalent (n=2) metal ion, preferably selected from Na, K, Mg, Ca and Sr. x is a number from 0.1 to 0.5, preferably from 0.2 to 0.4, more preferably from 0.25 to 0.35. z is a number from 0 to 2. The value of (x+y) is the layer charge of said first clay, preferably the value of (x+y) is in the range of from 0.1 to 0.5, preferably from 0.2 to 0.4, more preferably from 0.25 to 0.35.

The Inventors have found that a specific volume weight mean particle size of hectorite clay, typically from 5 micrometers to 20 micrometers, further improves the fabric softening benefit provided. Therefore, the hectorite clay for use herein preferably has a volume weight mean particle size of from 5 micrometers to 20 micrometers, preferably from 7 micrometers to 19 micrometers, more preferably from 10 micrometers to 18 micrometers, more preferably from 12 micrometers to 17 micrometers, more preferably from 14 micrometers to 16 micrometers. The method for determining said volume weight mean particle size of said first clay is described in more detail hereinafter Also, the inventors have found that when the hectorite clay has a lathe-like primary platelet shape, typically defined by an aspect ratio of greater than 3:1, then the fabric softening benefit provided is further improved. Therefore the hectorite clay, especially the primary platelets of said hectorite clay, has an aspect ratio of greater than 3:1, more preferably greater than 5:1, more preferably greater then 7:1, or preferably from 7:1 to 15:1. The aspect ratio of the primary platelets is typically defined as the ratio of the average length of the primary platelets to the average width of the primary platelets. It is believed that the small particles of the hectorite clay which have primary platelets that are more elongated in structure, more easily fit into the crevices of the fabric and give an improved softening benefit during the washing process.

Preferred hectorite clays for use herein are those having a cationic exchange capacity of at least 90 meq/100 g. The cationic exchange capacity of clays can be measured using the method described in Grimshaw, The Chemistry and Physics of Clays, Interscience Publishers, Inc., pp. 264–265 (1971).

An especially preferred hectorite clay is that supplied by Rheox under the trade name Bentone HC. Other preferred hectorite clays for use herein are those hectorite clays supplied by CSM Materials under the trade name Hectorite U and Hectorite R, respectively.

Dioctahedral Smectite Clay

The composition herein comprises a dioctahedral smectite clay. Any dioctahedral smectite clay can be used herein, preferred dioctahedral smectite clays for use herein are montmorillonite clays.

Dioctahedral smectite clays for use herein typically have the general formula $$Na_xAl_{2-x}Mg_xSi_4O_{10}(OH)_2 \quad \text{(II)}$$

or $$Ca_xAl_{2-x}Mg_xSi_4O_{10}(OH)_2 \quad \text{(III)}$$

wherein x is a number from 0.1 to 0.5, preferably from 0.2 to 0.4.

Preferred dioctahedral smectite clays are low charge montmorillonite clays (also known as a sodium montmorillonite clay or Wyoming type montmorillonite clay) which have a general formula corresponding to formula (II) above, or high charge montmorillonite clays (also known as a calcium montmorillonite clay or Cheto type montmorillonite clay) which have a general formula corresponding to formula (III).

The Inventors have found that when the dioctahedral smectite clay has a specific volume weight mean particle size, typically of more than 20 micrometers, then the fabric softening benefit provided is further improved. Therefore, preferably the dioctahedral smectite clay has a volume weight mean particle size of more than 20 micrometers, preferably more than 23 micrometers, preferably more than 25 micrometers, or preferably from 21 micrometers to 60 micrometers, more preferably from 22 micrometers to 50 micrometers, more preferably from 23 micrometers to 40 micrometers, more preferably from 24 micrometers to 30 micrometers, more preferably from 25 micrometers to 28 micrometers. The method for determining said volume weight mean particle size of said second clay is described in more detail hereinafter.

Method for Determining the Volume Weight Mean Particle Size of the First Clay and Second Clay The volume weight mean particle size of the hectorite clay and dioctahedral smectite clay, respectively, is determined using the following method:

12 g clay is placed in a glass beaker containing 250 ml distilled water and vigorously stirred for 5 minutes to form a clay solution. The clay is not sonicated, or microfluidised in a high pressure microfluidizer processor, but is added to said beaker of water in an unprocessed form (i.e. it's raw form). 1 ml clay solution is added to the reservoir volume of an Accusizer 780 single-particle optical sizer (SPOS) using a micropipette. The clay solution that is added to the reservoir volume of said Accusizer 780 SPOS is diluted in more distilled water to form a diluted clay solution, this dilution occurs in the reservoir volume of said Accusizer 780 SPOS and is an automated process that is controlled by said Accusizer 780 SPOS which determines the optimum concentration of said diluted clay solution, for determining the volume weight mean particle size of the clay particles in the diluted clay solution. The diluted clay solution is left in the reservoir volume of said Accusizer 780 SPOS for 3 minutes. The clay solution is vigorously stirred for the whole period of time that it is in the reservoir volume of said Accusizer 780 SPOS. The diluted clay solution is then sucked through the sensors of said Accusizer 780 SPOS, this is an automated process that is controlled by said Accusizer 780 SPOS which determines the optimum flow rate of the diluted clay solution through the sensors, for determining the volume weight mean particle size of the clay particles in the diluted clay solution. All of the steps of this method are carried out at a temperature of 20° C. This method is carried out in triplicate and the mean of these results determined.

Hydrophobically Modified Cellulosic Based Polymers

The composition herein preferably comprises (by weight of said composition) from 0.01% to 50%, preferably from 0.05% to 20%, more preferably from 0.05% to 15%, more preferably from 0.05% to 10%, more preferably from 0.05% to 5%, more preferably from 0.05% to 3%, more preferably from 0.1% to 2% a hydrophobically modified cellulosic based polymer. The hydrophobically modified cellulosic based polymers herein include polymers, oligomers, copolymers and also cross-linked polymers, oligomers and copolymers. The term "hydrophobically modified cellulosic based polymer" is herein referred to as "cellulosic based polymer". As will be apparent to those skilled in the art, an oligomer is a molecule consisting of only a few monomer units while polymers comprise considerably more monomer units. For the present invention, oligomers are defined as molecules having a mean average molecular weight of below 1,000 daltons and polymers are molecules having a mean average molecular weight of greater than 1,000 daltons. One suitable type of cellulosic-based polymer herein has a mean average molecular weight of from about 5,000 daltons to about 2,000,000, daltons preferably from about 50,000 daltons to about 1,000,000 daltons. Gel permeation chromatography is one suitable method for measuring molecular weight.

The cellulosic based polymer for use herein is preferably of the following formula:

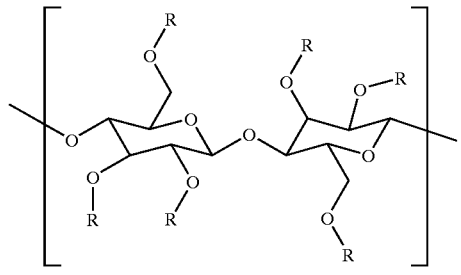

wherein each R is selected from the group consisting of $R_2$, $R_C$, and

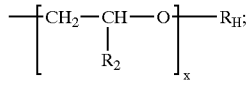

wherein:

each $R_2$ is independently selected from the group consisting of H and $C_1$–$C_4$ alkyl;

each $R_C$ is

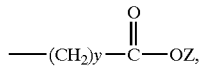

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2N$-alkyl, $(R_4)_2N$-2-hydroxyalkyl, $(R_4)_3N$-alkyl, $(R_4)_3N$-2-hydroxyalkyl, $C_6$–$C_{12}$ aryloxy-2-hydroxyalkyl,

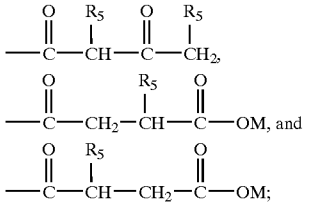

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2N$-alkyl, and $(R_4)_3N$-alkyl;

wherein:

M is a suitable cation selected from the group consisting of Na, K, ½Ca, and ½Mg;

each x is from 0 to about 5;

each y is from about 1 to about 5; and provided that:

the Degree of Substitution for group $R_H$ is between about 0.001 and 0.1, more preferably between about 0.005 and 0.05, and most preferably between about 0.01 and 0.05;

the Degree of Substitution for group $R_C$ wherein Z is H or M is between about 0.2 and 2.0, more preferably between about 0.3 and 1.0, and most preferably between about 0.4 and 0.7;

if any $R_H$ bears a positive charge, it is balanced by a suitable anion; and two $R_4$'s on the same nitrogen can together form a ring structure selected from the group consisting of piperidine and morpholine.

The "Degree of Substitution" for group $R_H$, which is sometimes abbreviated herein "$DS_{RH}$", means the number of moles of group $R_H$ components that are substituted per anhydrous glucose unit, wherein an anhydrous glucose unit is a six membered ring as shown in the repeating unit of the general structure above.

The "Degree of Substitution" for group $R_C$, which is sometimes abbreviated herein "$DS_{RC}$", means the number of moles of group $R_C$ components, wherein Z is H or M, that are substituted per anhydrous glucose unit, wherein an anhydrous glucose unit is a six membered ring as shown in the repeating unit of the general structure above. The requirement that Z be H or M is necessary to insure that there are a sufficient number of carboxy methyl groups such that the resulting polymer is soluble. It is understood that in addition to the required number of $R_C$ components wherein Z is H or M, there can be, and most preferably are, additional $R_C$ components wherein Z is a group other than H or M.

Flocculation Agent

The composition herein may preferably comprise a flocculation agent, preferably present at a level of from 0.005% to 10%, more preferably from 0.01% to 5%, more preferably from 0.05% or even 0.1% to 1% by weight of said composition. The flocculation agent may be present in said composition as part of the detergent base granule, or if the clay system is present in said composition as a separate pre-formed particle, the flocculation agent may be present in the composition as part of said separate pre-formed particle. Preferred flocculation agents herein are organic polymeric materials having a mean average molecular weight of from 100,000 daltons to 10,000,000 daltons, preferably from 150,000 daltons to 500,0000 daltons, more preferably from 200,000 daltons to 2,000,000 daltons. Suitable organic polymeric materials comprise homopolymers or copolymers containing monomeric units selected from alkylene oxide, particularly ethylene oxide, acrylamide, acrylic acid, vinyl alcohol, vinyl pyrrolidone and ethylene imine. Homopolymers of ethylene oxide, acrylamide and acrylic acid are preferred. European patents Nos.: EP-A-299,575 and EP-A-313146 in the name of The Procter and Gamble Company describe preferred organic polymeric flocculation agents for use herein. Highly preferred are polyethylene oxides of a mean average molecular weight of from 150,000 daltons to 3,000,000 daltons. Inorganic flocculation agents may also be suitable for use herein, typical examples of which include lime and alum.

Cyclic Amine Based Polymer Materials

It may be preferred that the composition herein comprises one or more cyclic amine based polymer. The composition herein may comprise (by weight of said composition) from 0.05% to 10%, preferably from 0.05% to 5% or even from 0.05% to 3% or even 0.1% to 2% cyclic amine based polymer. When used herein, 'polymers' include not only polymers, but also oligomers, co-polymers, co-oligomers, present in any structural arrangement, also including cross-linked arrangements. As will be apparent to those skilled in the art, an oligomer is a molecule consisting of only a few monomer units while polymers comprise considerably more monomer units. For the present invention, oligomers are defined as molecules having a mean average molecular weight below 1,000 daltons and polymers are molecules having a mean average molecular weight of greater than 1,000 daltons; copolymers or co-oligomers are materials wherein two or more dissimilar monomers have been simultaneously or sequentially polymerized. Copolymers or co-oligomers for use herein can include, for example, polymers or oligomers polymerized from a mixture of a primary cyclic amine based monomer, e.g., piperadine, and a secondary cyclic amine monomer, e.g., morpholine.

The preferred cyclic amine based polymers herein can be characterized by the following general formula:

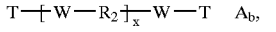

wherein;

each T is independently selected from the group consisting of H, $C_1$–$C_{12}$ alkyl, substituted alkyl, $C_7$–$C_{12}$ alkylaryl, $—(CH_2)_nCOOM$, $—(CH_2)_nSO_3M$, $CH_2CH(OH)SO_3M$, $—(CH_2)_nOSO_3M$,

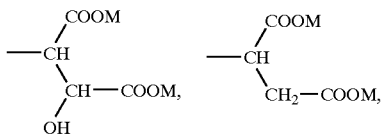

-continued

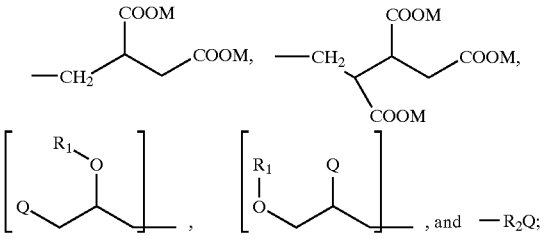

wherein W comprises at least one cyclic constituent selected from the group consisting of:

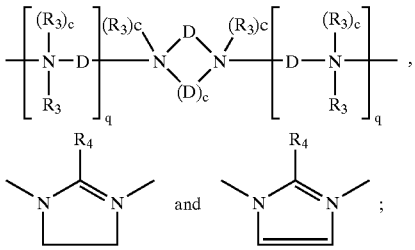

in addition to the at least one cyclic constituent, W may also comprise an aliphatic or substituted aliphatic moiety of the general structure;

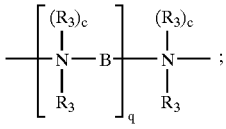

each B is independently $C_1$–$C_{12}$ alkylene, $C_1$–$C_{12}$ substituted alkylene, $C_3$–$C_{12}$ alkenylene, $C_8$–$C_{12}$ dialkylarylene, $C_8$–$C_{12}$ dialkylarylenedlyl, and —$(R_5O)_nR_5$—;

each D is independently $C_2$–$C_6$ alkylene;

each Q is independently selected from the group consisting of hydroxy, $C_1$–$C_{18}$ alkoxy, $C_2$–$C_{18}$ hydroxyalkoxy, amino, $C_1$–$C_{18}$ alkylamino, dialkylamino, trialkylamino groups, heterocyclic monoamino groups and diamino groups;

each $R_1$ is independently selected from the group consisting of H, $C_1$–$C_8$ alkyl and $C_1$–$C_8$ hydroxyalkyl;

each $R_2$ is independently selected from the group consisting of $C_1$–$C_{12}$ alkylene, $C_1$–$C_{12}$ alkenylene, —$CH_2$—$CH(OR_1)$—$CH_2$, $C_8$–$C_{12}$ alkarylene, $C_4$–$C_{12}$ dihydroxyalkylene, poly($C_2$–$C_4$ alkyleneoxy)alkylene, $H_2CH(OH)CH_2OR_2OCH_2CH(OH)CH_2$—, and $C_3$–$C_{12}$ hydrocarbyl moieties;

provided that when $R_2$ is a $C_3$–$C_{12}$ hydrocarbyl moiety the hydrocarbyl moiety can comprise from about 2 to about 4 branching moieties of the general structure:

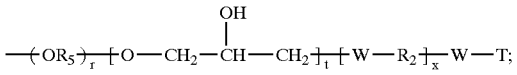

each $R_3$ is independently selected from the group consisting of H, O, $R_2$, $C_1$–$C_{20}$ hydroxyalkyl, $C_1$–$C_{20}$ alkyl, substituted alkyl, $C_6$–$C_{11}$ aryl, substituted aryl, $C_7$–$C_{11}$ alkylaryl, $C_1$–$C_{20}$ aminoalkyl, —$(CH_2)_nCOOM$, —$(CH_2)_nSO_3M$, $CH_2CH(OH)SO_3M$, —$(CH_2)_nOSO_3M$,

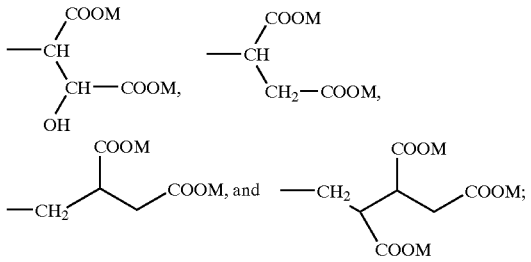

each $R_4$ is independently selected from the group consisting of H, $C_1$–$C_{22}$ alkyl, $C_1$–$C_{22}$ hydroxyalkyl, aryl and $C_7$–$C_{22}$ alkylaryl;

each $R_5$ is independently selected from the group consisting of $C_2$–$C_8$ alkylene, $C_2$–$C_8$ alkyl substituted alkylene; and A is a compatible monovalent or di or polyvalent anion;

M is a compatible cation;

b=number necessary to balance the charge;

each x is independently from 3 to about 1000;

each c is independently 0 or 1;

each h is independently from about 1 to about 8;

each q is independently from 0 to about 6;

each n is independently from 1 to about 20;

each r is independently from 0 to about 20; and each t is independently from 0 to 1.

The cyclic amine based polymer may comprise combinations of these cyclic amine based materials. For example, a mixture of piperadine and epihalohydrin condensates can be combined with a mixture of morpholine and epihalohydrin condensates to achieve the desired fabric treatment results. Moreover, the molecular weight of the cyclic polymers can vary as is illustrated herein.

Preferred cyclic amine based polymers that fall within this general structure include compounds:

wherein each $R_1$ is H; and at least one W is selected from the group consisting of:

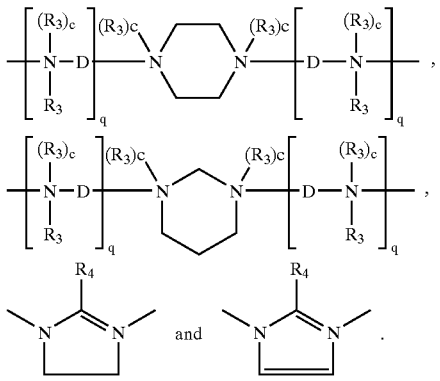

Even more preferred compounds are those:

wherein each $R_1$ is H; and at least one W is selected from the group consisting of:

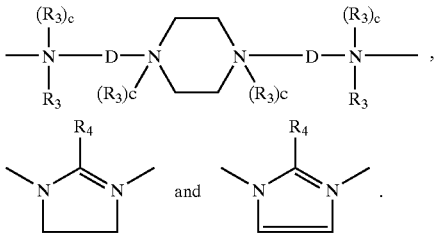

And most preferred compounds are those:

wherein each $R_1$ is H; and at least one W is selected from the group consisting of:

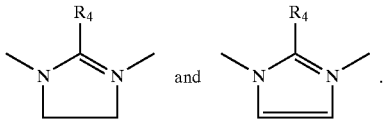

Preferred compounds to be used as the linking group $R_2$ include, but are not limited to: polyepoxides, ethylenecarbonate, propylenecarbonate, urea, α, β-unsaturated carboxylic acids, esters of α, β-unsaturated carboxylic acids, amides of α, β-unsaturated carboxylic acids, anhydrides of α, β-unsaturated carboxylic acids, di- or polycarboxylic acids, esters of di- or polycarboxylic acids, amides of di- or polycarboxylic acids, anhydrides of di- or polycarboxylic acids, glycidylhalogens, chloroformic esters, chloroacetic esters, derivatives of chloroformic esters, derivatives of chloroacetic esters, epihalohydrins, glycerol dichlorohydrins, bis-(halohydrins), polyetherdihalo-compounds, phosgene, polyhalogens, functionalized glycidyl ethers and mixtures thereof. Moreover, $R_2$ can also comprise a reaction product formed by reacting one or more of polyetherdiamines, alkylenediamines, polyalkylenepolyamines, alcohols, alkyleneglycols and polyalkyleneglycols with α, β-unsaturated carboxylic acids, esters of α, β-unsaturated carboxylic acids, amides of α, β-unsaturated carboxylic acids and anhydrides of α, β-unsaturated carboxylic acids provided that the reaction products contain at least two double bonds, two carboxylic groups, two amide groups or two ester groups.

Also preferred cyclic amine based polymers for use herein include adducts of two or more compounds selected from the group consisting of piperazine, piperadine, epichlorohydrin, epichlorohydrin benzyl quat, epichlorohydrin methyl quat, morpholine and mixtures thereof.

Highly preferred cyclic amine based polymers herein are referred to as Imidazole-epi chlorohydrin copolymers.

These cyclic amine based polymers can be linear or branched. One specific type of branching can be introduced using a polyfunctional crosslinking agent. An example of such a polymer is exemplified below.

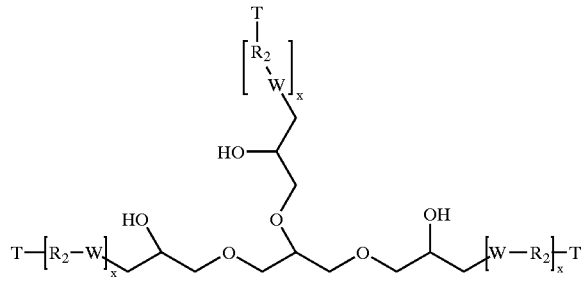

Optional Detergent Ingredients

The composition herein may comprise the following detergent ingredients:

Surfactant

The composition herein preferably contains one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vols. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitterionic surfactants are generally used in combination with one or more anionic and/or nonionic surfactants.

Anionic Surfactant

The composition herein preferably comprises an additional anionic surfactant. Essentially any anionic surfactants useful for detersive purposes can be comprised in the composition herein. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and -N-($C_1$–$C_2$ hydroxyalkyl) glucamine sulfates, and sulfates of alkylpolysaccharides such as the sulfates of alkylpolyglucoside (the nonionic nonsulfated compounds described herein).

Alkyl sulfate surfactants are preferably selected from the linear and branched primary $C_{10}$–C18 alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_20)_x\ CH_2C00^-M^+$wherein R is a $C_6$ to $C_{18}$ alkyl group, x ranges from O to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressers.

Alkali Metal Sarcosinate Surfactant

Other suitable anionic surfactants are the alkali metal sarcosinates of formula $R—CON\ (R^1)\ CH_2\ COOM$, wherein R is a $C_5$–$C_{17}$ linear or branched alkyl or alkenyl group, $R_1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, non ionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–C17 alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $—(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(glycosyl)_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10}$-$_{18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the composition herein. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12}$–$C_{18}$ dimethyl-ammonio hexanoate and the $C_{10-18}$ acylamidopropane (or ethane) dimethyl (or diethyl) betaines. Complex betaine surfactants are also suitable for use herein.

Cationic Surfactants

Suitable cationic surfactants to be used in the composition herein include the quaternary ammonium surfactants. Preferably the quaternary ammonium surfactant is a mono $C_6$–$C_{16}$, preferably $C_6$–$C_{10}$N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the Compositions herein are cationic ester surfactants.

The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect, the spacer group chain comprises only carbon atoms, most preferably the chain is a hydrocarbyl chain.

Cationic Mono-Alkoxylated Amine Surfactants

Highly preferred herein are cationic mono-alkoxylated amine surfactant preferably of the general formula I:

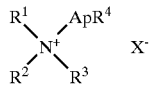

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; X– is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$H_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

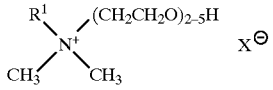

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in the composition herein is preferably from 0.1% to 20%, more preferably from 0.2% to 7%, most preferably from 0.3% to 3.0% by weight of said composition.

Cationic Bis-Alkoxylated Amine Surfactant

The cationic bis-alkoxylated amine surfactant preferably has the general formula II:

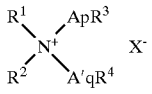

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

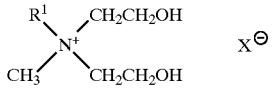

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

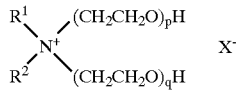

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Building Agent

The composition herein may comprise one or more building agents. Preferred building agents are described in more detail hereinafter. These building agents may be water-soluble building compounds, also herein referred to as water-soluble builder compounds, or water-insoluble or partially water-insoluble building agents, also herein referred to as insoluble builder compounds or partially soluble builder compounds.

Water-Soluble Builder Compound

The composition herein may preferably contain a water-soluble builder compound, typically present in said compositions at a level of from 1% to 80% by weight, preferably from 10% to 60% by weight, most preferably from 15% to 40% by weight of the composition.

The composition herein may preferably comprise phosphate-containing builder material. Preferably present at a level of from 0.5% to 60%, more preferably from 5% to 50%, more preferably from 8% to 40% by weight of the composition.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be monomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymetal/phosphate in which the degree of polymerization ranges from about 6 to 21, and salts of phytic acid.

Partially Soluble or Insoluble Builder Compound

The compositions herein may contain a partially soluble or insoluble builder compound, typically present at a level of from 0.5% to 60% by weight, preferably from 5% to 50% by weight, most preferably from 8% to 40% by weight of the composition.

Examples of largely water insoluble builders include the sodium aluminosilicates.

Suitable aluminosilicate zeolites have the unit cell formula $Na_z[(AlO_2)_z(SiO_2)_y]. xH_2O$ wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}]. 276\ H_2O$.

Another preferred aluminosilicate zeolite is zeolite MAP builder. The zeolite MAP can be present at a level of from 1% to 80%, more preferably from 15% to 40% by weight of the composition.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Chelating Agent

The composition herein may comprise one or more chelating agents, also herein referred to as heavy metal ion sequestrant. Preferred chelating agents are described in more detail hereinafter.

Heavy Metal Ion Sequestrant

The compositions herein preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the composition.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and imino-disuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Bleaching Agent

The composition herein may comprise one or bleaching agents. Preferred bleaching agents for use herein are described in more detail hereinafter.

Perhydrate Bleaches

A preferred additional bleaching agent is a perhydrate bleach, such as metal perborates, metal percarbonates, particularly the sodium salts. Perborate can be mono or tetra hydrated. Sodium percarbonate has the formula corresponding to $2Na_2CO_3 \cdot 3H_2O_2$, and is available commercially as a crystalline solid.

Potassium peroxymonopersulfate, sodium per is another optional inorganic perhydrate salt of use in the composition herein.

Organic Peroxyacid Bleaching System

A preferred feature of the composition herein is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach. In an alternative preferred execution a preformed organic peroxyacid is incorporated directly into the composition herein. The composition herein may contain mixtures of a hydrogen peroxide source and organic peroxyacid precursor in combination with a preformed organic peroxyacid.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

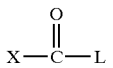

where L is a leaving group and X is essentially any functionality, such that on perhydroloysis the structure of the peroxyacid produced is

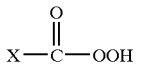

Peroxyacid bleach precursor compounds are preferably incorporated at a level of from 0.5% to 20% by weight, more preferably from 1% to 15% by weight, most preferably from 1.5% to 10% by weight of the composition herein.

Suitable peroxyacid bleach precursor compounds typically contain one or more N- or 0-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle).

However, if L is too reactive, this activator will be difficult to stabilize for use herein.

Preferred L groups are selected from the group consisting of:

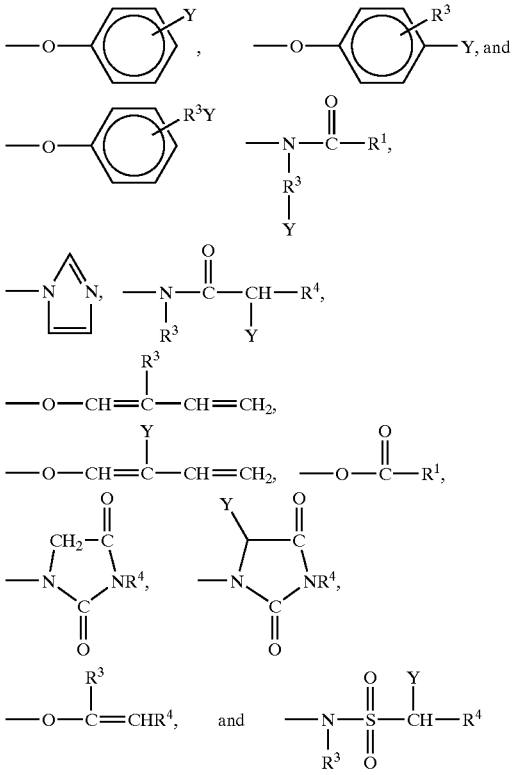

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$and $O<--N(R^3)_3$ and most preferably $—SO_3^-M^+$and $—CO_2^-M^+$wherein $R^3$ i containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable for use herein, including those of the following general formulae:

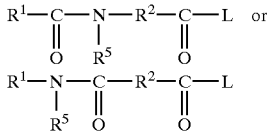

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Preformed Organic Peroxyacid

The composition herein may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

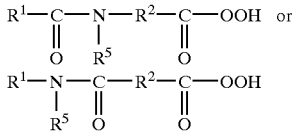

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Enzyme

Another preferred ingredient useful in the composition herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into the composition herein. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the composition herein at a level of from 0.0001% to 4% active enzyme by weight of the composition.

Preferred amylases include, for example, a-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in WO95/26397 and WO96/23873.

Amylase enzyme may be incorporated into the composition herein at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the composition.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Suds Suppressing System

The composition herein, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The composition herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The composition herein also optionally contain from about 0.005% to 5% by weight of certain types of hydrophilic optical brighteners.

Hydrophilic optical brighteners useful herein include those having the structural formula:

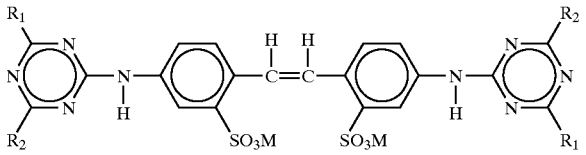

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, R1 is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the composition herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Other Optional Ingredients

Other optional ingredients suitable for use herein include perfumes, colours and filler salts, with sodium sulfate being a preferred filler salt.

Preferably, the composition herein may contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981, can be present.

Composition

The composition herein is a solid detergent composition. The composition herein can be in any solid form, such as a granular composition or for example a tablet, flake, extrudate, agglomerate or granule containing composition. The composition herein can be made by methods such as dry-mixing, agglomerating, compaction, spray drying of various ingredients comprised in the composition herein, or a combination thereof. The composition herein preferably has a bulk density of from 300 g/liter or even 350 g/liter or 450 g/liter to preferably 1500 g/liter or 1000 g/liter or even to 850 g/liter.

The composition herein comprises a hectorite clay and a dioctrahedral smectite clay. The ratio of said hectorite clay to said dioctrahedral smectite clay is less than 1:1, preferably less than 0.8:1, more preferably less than 0.6:1, or preferably from 0.1:1 to 0.9:1, more preferably from 0.2:1 to 0.7:1, more preferably from 0.2:1 to 0.5:1.

Preferably, said composition comprises (by weight of said composition) an amount of clay of no more than 10%, or preferably from 1% to 10%, preferably from 5% to 15%, more preferably from 7% to 10%. Preferably, said clay comprises (by weight of said clay) no more than 35%, preferably less than 35% impurities such as mineral impurities, typical mineral impurities include calcite.

Preferably, the clay is present in said composition as a separate preformed particle or as a coating for a detergent ingredient particle, preferably as a separate preformed particle. Preferably, said preformed particle has a weight average particle size of from 250 micrometers to 1500 micrometers, more preferably from 500 micrometers to 1350 micrometers, more preferably from 600 micrometers to 1200 micrometers, more preferably from 800 micrometers to 1000 micrometers. Said hectorite clay and said dioctrahedral smectite clay may be present in the same separate preformed particle or may be present in different preformed particles.

Said preformed particle may comprise additional detergent ingredients such as surfactant, building agent, chelating agent, bleaching agent, filler agent or combination thereof. Preferably, said preformed particle comprises one or more binding agents. Typical binding agents for use herein include humectant and/or hydrophobic compounds, preferably a wax or oil such as paraffin oil. Preferred binding agents are organic compounds, including propylene glycol, ethylene glycol, dimers or trimers of glycol, most preferably glycerol. Another preferred binding agent is water. It may also be preferred that the preformed particle comprises a flocculation agent, said flocculation agent is described in more detail herein. Preferably, said preformed particle is in the form of an agglomerate, extrudate, spray dried granule or combination thereof, preferably an agglomerate. Preferably, said preformed particle is in the form of an agglomerate and comprises a binding agent.

Laundry Washing Method

Laundry washing methods herein typically comprise treating soiled laundry with an aqueous wash solution for washing by machine or for washing by hand, having dissolved or dispensed therein an effective amount of the composition herein. By an effective amount of the composition it is meant from 40 g to 300 g of said composition dissolved or dispersed in a wash solution of volume from 1 to 65 liters, as are typical product dosages and wash solution volumes commonly employed in conventional laundry methods. Other laundry washing processes known in the art can also be used.

EXAMPLES

Example I 150 g hectorite clay powder supplied by Rheox under the trade name Bentone HC and 300 g montmorillonite clay powder supplied by CSM under the trade name "AP base" is added to a food mixer and mixed at half speed for 10 seconds to form a clay mixture. 22.5 g glyerol is slowly added to the clay mixture which is being constantly mixed at half speed during the period of glycerol addition to form a glycerol-clay mixture. 90 g distilled water is slowly added to the glycerol-clay mixture which is being constantly mixed at full speed during the period of water addition to form moist clay agglomerates. 15 g molten paraffin wax at a temperature of 70° C. is added to the moist clay agglomerates and the agglomerates are mixed at full speed in the food mixer for 5 seconds.

The moist clay agglomerates are then transferred to a Sherwood fluidised bed dryer and dried for 5 minutes to form clay agglomerates. The air temperature in the drier is 60° C. and the air flow rate in the drier is 1.2 meter/second during the drying period. The moisture content of the clay agglomerates after the drying step is 5% by weight of the agglomerates. The clay agglomerates are then sieved using a ROTAP sieve with mesh sizes of 250 micrometers and 1180 micrometers, and the clay agglomerates having a particle size of from 250 micrometers to 1180 micrometers are collected. 15 g clay agglomerates are added to 120 g base detergent powder comprising ester carboxymethyl cellulose, polyethylene oxide, surfactant, sodium carbonate, sodium sulphate, zeolite, enzymes and suds suppressor, to form a solid detergent composition in accord with the present invention.

Example II 450 g hectorite clay powder supplied by Rheox under the trade name Bentone is added to a food mixer. 22.5 g glyerol is slowly added to the clay mixture which is being constantly mixed at half speed during the period of glycerol addition to form a glycerol-clay mixture. 120 g distilled water is slowly added to the glycerol-clay mixture which is being constantly mixed at full speed during the period of water addition to form moist hectorite clay agglomerates. 15 g molten paraffin wax at a temperature of 70° C. is added to the moist hectorite clay agglomerates and the agglomerates are mixed at full speed in the food mixer for 5 seconds. The moist hectorite clay agglomerates are then transferred to a Sherwood fluidised bed dryer and dried for 6 minutes to form hectorite clay agglomerates. The air temperature in the drier is 60° C. and the air flow rate in the drier is 1.2 meter/second during the drying period. The moisture content of the hectorite clay agglomerates after the drying step is 5% by weight of the agglomerates. The hectorite clay agglomerates are then sieved using a ROTAP sieve with mesh sizes of 250 micrometers and 1180 micrometers, and the hectorite clay agglomerates having a particle size of from 250 micrometers to 1180 micrometers are collected.

Then, 450 g montmorillonite clay powder supplied by CSM under the trade name "AP base" is added to a food mixer. 22.5 g glyerol is slowly added to the clay mixture which is being constantly mixed at half speed during the period of glycerol addition to form a glycerol-clay mixture. 70 g distilled water is slowly added to the glycerol-clay mixture which is being constantly mixed at full speed during the period of water addition to form moist montmorillonite clay agglomerates. 15 g molten paraffin wax at a temperature of 70° C. is added to the moist montmorillonite clay agglomerates and the agglomerates are mixed at full speed in the food mixer for 5 seconds. The moist montmorillonite clay agglomerates are then transferred to a Sherwood fluidised bed dryer and dried for 4 minutes to form montmorillonite clay agglomerates. The air temperature in the drier is 60° C. and the air flow rate in the drier is 1.2 meter/second during the drying period. The moisture content of the montmorillonite clay agglomerates after the drying step is 5% by weight of the agglomerates. The montmorillonite clay agglomerates are then sieved using a ROTAP sieve with mesh sizes of 250 micrometers and 1180 micrometers, and the montmorillonite clay agglomerates having a particle size of from 250 micrometers to 1180 micrometers are collected.

5 g hectorite clay agglomerates and 10 g montmorillonite clay agglomerates are added to 120 g base detergent powder comprising, ester carboxymethyl cellulose, polyethylene oxide, surfactant, sodium carbonate, sodium sulphate, zeolite, enzymes and suds suppressor, to form a solid detergent composition in accord with the present invention.

Example III 3 g hectorite clay powder supplied by Rheox under the trade name Bentone HC and 7 g montmorillonite clay powder supplied by CSM under the trade name "AP base" are added to and dry mixed with 125 g base detergent powder comprising ester carboxymethyl cellulose, polyethylene oxide, surfactant, sodium carbonate, sodium sulphate, zeolite, enzymes and suds suppressor, to form a solid detergent composition in accord with the present invention.

Example IV

The following compositions are solid detergent compositions in accord with the present invention. The amounts of the detergent ingredients are shown as % by weight of said composition.

| | A | B | C | D | E |
|---|---|---|---|---|---|
| Hectorite clay | 3 | 3 | 3 | 4 | 1 |
| Montmorillonite clay | 6 | 5 | 7 | 7 | 8 |
| Ester carboxymethyl cellulose | 0.1 | 0.2 | 1 | 2 | |
| Polyethylene oxide | | 0.2 | | 0.1 | 1 |
| Imidazole-epi chlorohydrin -copolymer | 1 | | 0.1 | | 0.5 |
| Nonionic surfactant | 10 | 20 | 15 | 20 | 5 |
| Anionic Surfactant | 5 | | | 5 | 17 |
| Cationic Surfactant | 5 | | 5 | | |
| Sodium tripolyphosphate | | 5 | 10 | | 20 |
| Zeolite | 15 | 10 | 5 | 20 | |
| Chelating agent | | | 0.4 | | 1 |
| Bleaching agent | | | 10 | | 8 |
| Suds Suppressor | 0.4 | 0.05 | | 0.1 | 0.2 |
| Carbonate | 15 | 10 | 15 | 30 | 25 |
| Sulphate | 25 | 20 | 15 | 10 | 25 |
| Enzyme | 0.1 | | 0.4 | | |
| Minors and water | to 100 | to 100 | to 100 | to 100 | to 100 |

What is claimed is:

1. A solid detergent composition comprising a hectorite clay, a dioctahedral smectite clay, and from 0.01 to 50% by weight of a hydrophobically modified cellulosic based polymer, said hydrophobically modified cellulosic based polymer having a mean average molecular weight of from 50,000 daltons to 2,000,000 daltons, and wherein the weight ratio of said hectorite clay to said dioctahedral smectite clay is less than 1:1.

2. A composition according to claim 1, whereby said hectorite clay has the general formula $$[(Mg_{3-x}Li_x)SI_{4-y}Me^{III}{}_yO_{10}(OH_{2-z}F_z)]^{-(x+y)}((x+y)/n)M^{n+}$$

wherein y=0 to 0.4, and whereby if y=>0 then $Me^{III}$ is Al, Fe or B; $Mn^+$is a monovalent (n=1) or a divalent (n=2) metal ion; x is a number from 0.1 to 0.5; z is a number from 0 to 2, and the value of (x+y) is in the range of from 0.1 to 0.5.

3. A composition according to claim 1, whereby said dioctahedral smectite clay is a montmorillonite clay, said montmorillonite clay having the general formula $$Na_xAl_{2-x}Mg_xSi_4O_{10}(OH)_2$$

or $$Ca_xAl_{2-x}Mg_xSi_4O_{10}(OH)_2$$

wherein x is a number from 0.1 to 0.5.

4. A composition according to claim 1, whereby said hectorite clay has an aspect ratio of greater than 3:1.

5. A composition according to claim 1, whereby said hectorite clay has a volume weight mean particle size of from 5 micrometers to 20 micrometers, and/or said dioctahedral clay has a volume weight mean particle size of more than 20 micrometers.

6. A composition according to claim 1, whereby said, composition comprises (by weight) an amount of clay of no more than 10%.

7. A composition according to claim 1, whereby said composition comprises a flocculating agent.

8. A composition according to claim 1, whereby said composition comprises a cyclic amine based polymer.

9. A composition according to claim 1, whereby said hectorite clay and said dioctahedral smectite clay are present in said composition in the form of agglomerate particles.

* * * * *